United States Patent [19]

Bell

[11] Patent Number: 4,599,588

[45] Date of Patent: Jul. 8, 1986

[54] METHOD AND APPARATUS FOR ATTACHING LEADS

[75] Inventor: Richard E. Bell, Princeton, Ind.

[73] Assignee: AMF Incorporated, White Plains, N.Y.

[21] Appl. No.: 570,602

[22] Filed: Jan. 13, 1984

[51] Int. Cl.[4] ..... H01H 67/02

[52] U.S. Cl. ..... 335/127; 335/135; 79/854; 79/860; 339/275 R; 339/275 T

[58] Field of Search ..... 335/127, 128, 135; 339/102 R, 275 R, 275 A, 275 B, 275 C, 275 E, 275 T; 200/283, 284, 292, 293, 263, 264; 361/293; 29/602, 622, 854, 855, 860

[56] References Cited

U.S. PATENT DOCUMENTS

| | | | |
|---|---|---|---|
| 3,486,142 | 12/1969 | Little | 335/203 |
| 3,622,729 | 11/1971 | Ohno | 200/283 |
| 3,646,290 | 2/1972 | Borgmann | 200/284 |
| 3,720,892 | 3/1973 | Britton | 335/135 |
| 4,097,106 | 6/1978 | Over et al. | 339/102 R |
| 4,142,077 | 2/1979 | Lemanski | 200/284 |
| 4,180,715 | 12/1979 | Lichtenberger | 200/263 |
| 4,419,554 | 12/1983 | Osika | 200/284 |
| 4,447,794 | 5/1984 | Harbauer et al. | 335/128 |

FOREIGN PATENT DOCUMENTS

| | | | |
|---|---|---|---|
| 1010610 | 11/1965 | United Kingdom | 335/128 |
| 2011181 | 7/1979 | United Kingdom | 361/293 |

*Primary Examiner*—George Harris
*Attorney, Agent, or Firm*—Willian Brinks Olds Hofer Gilson & Lione

[57] ABSTRACT

A method and apparatus for attaching leads to the movable armature assembly of a relay or to other movable elements. The apparatus includes a rigid, nonconductive carrier member (41) mounted to the armature of the relay and provided with a plurality of grooves (51) on one end for receipt of the leads (56). The opposite end of the carrier is adapted to receive and support the movable contact arms (59) such that the arms will intersect the grooves. The conductive cover is trimmed away from the ends of the leads to expose the wires which may be welded or otherwise attached to the contact arms. The leads are also firmly attached to the carrier farther back along the leads where the conductive cover remains intact. In operation, as the armature assembly moves up and down during the operation of the relay, the exposed lead wires will be prevented from bending back and forth by the surrounding carrier. Instead, the bending forces will be shifted back along the leads to where they are attached to the carrier; and since the lead covers are still intact at that location, the leads will be better able to withstand the bending forces. The carrier is preferably formed of an insulating thermoplastic material to permit the carrier to be attached to the armature and the leads to the carrier quickly and reliably by utilizing an ultrasonic tool to soften and reform the carrier material at the proper locations. The relay is enclosed within a plastic housing provided with a pair of stop portions to help maintain the armature and the carrier member mounted thereon in position on the relay.

28 Claims, 6 Drawing Figures

METHOD AND APPARATUS FOR ATTACHING LEADS

TECHNICAL FIELD

The present invention relates generally to a method and apparatus for attaching electrically conductive leads to movable elements, and, more particularly, to a method and apparatus for securing leads to the movable contact arm of a relay.

BACKGROUND ART

The present invention is particularly directed to a relay of the type in which electrically conductive leads are adapted to be directly attached to the movable contact support member of the relay. Typically, they are attached by trimming off a portion of the insulating cover from the end of the lead, and then soldering or otherwise connecting the exposed wires to the spring arm or to another conductive portion of the armature assembly.

This is not a very satisfactory manner of construction. Specifically, as the armature assembly pivots back and forth during the operation of the relay, the exposed wires will be caused to bend first in one direction and then the other; and although the extent of bending might be quite small, it will gradually weaken the wires until eventually they are likely to break. This can result in a costly period of downtime for the equipment being operated by the relay, as well as in the need to repair or replace the relay.

Recognizing the high potential for wire breakage, workers in the art have endeavored to design relays that are better able to withstand the bending forces imparted to the lead by the pivoting movement of the armature. One approach has been to additionally attach the lead to the movable contact member at a second position farther back along the lead so that the bending forces will be shifted back from the vicinity of the exposed wires to a location where the insulating cover of the lead is still intact such that the lead will be much better able to withstand the forces. Typically, this is done by attaching some sort of clamping element to the movable contact member and then clamping the conductive leads in place.

There are several disadvantages to this approach. Initially, it increases the complexity and hence the cost of manufacturing the relay. In particular, relays in which conductive leads are connected directly to the movable contact member are typically of the type which are incorporated into several different switching circuits to simultaneously switch several different loads. Accordingly, they include several sets of contacts; and it is necessary to attach a conductive lead to the movable contact member of each set. This means that a plurality of clamping elements are required, and each must be attached to a movable contact member and a lead secured in each clamp. Also, since the clamping elements are frequently made of metal, care must be taken to ensure that the several movable contact members are kept electrically isolated from one another to the proper extent; and this sometimes necessitates an increase in the overall size of the relay which is undesirable as such relays are frequently mounted on printed circuit boards where size is an important factor.

DISCLOSURE OF THE INVENTION

In accordance with the present invention, an improved method and apparatus is provided for attaching electrical leads to the movable contact-supporting arm of a relay, or to another movable element, that will reliably protect the leads against breakage resulting from the movement of the arm and which permits the various elements to be attached effectively and efficiently without significantly increasing the cost of manufacturing the relay.

Specifically, according to a presently preferred embodiment, the invention comprises a rigid, non-conductive support or carrier member mounted to the relay armature. One end of the carrier has been designed to receive a plurality of movable, contact-supporting spring arms while the opposite end is provided with a plurality of passageways or grooves for receiving and supporting the ends of a plurality of conductor leads in electrical contact with the spring arms. The end portions of the leads is trimmed, as in the prior art, to permit the exposed wires to be attached to provide electrical connection to the spring arms; however, means are provided toward the back edge of each groove to secure the leads to the carrier where the insulating cover of the leads is intact so as to shift the bending forces back away from the location where the wires are exposed to where the leads are better able to withstand the stresses.

According to a further aspect of the invention, the carrier is formed of a single piece of thermoplastic material; and the leads are adapted to be secured to the carrier and the carrier attached to the armature of the relay by ultrasonic or other means which simultaneously causes the carrier material to be softened at the correct locations and then reformed in a manner to effect the attachments quickly and reliably. This greatly simplifies the manufacturing process and enables the cost of the relay to be kept within acceptable levels.

According to yet a further aspect of the invention, the relay is designed to be enclosed within a plastic housing which is formed with integral stops positioned to help maintain the armature and the carrier member mounted thereon in position on the relay. This design provides a simple yet effective way of maintaining the armature assembly properly positioned on the relay at all times.

Further objects and advantages of the invention will be set out hereinafter during the following detailed description of the best mode for carrying out the invention taken in conjunction with the drawings.

BEST MODE FOR CARRYING OUT THE INVENTION

Figure 1:
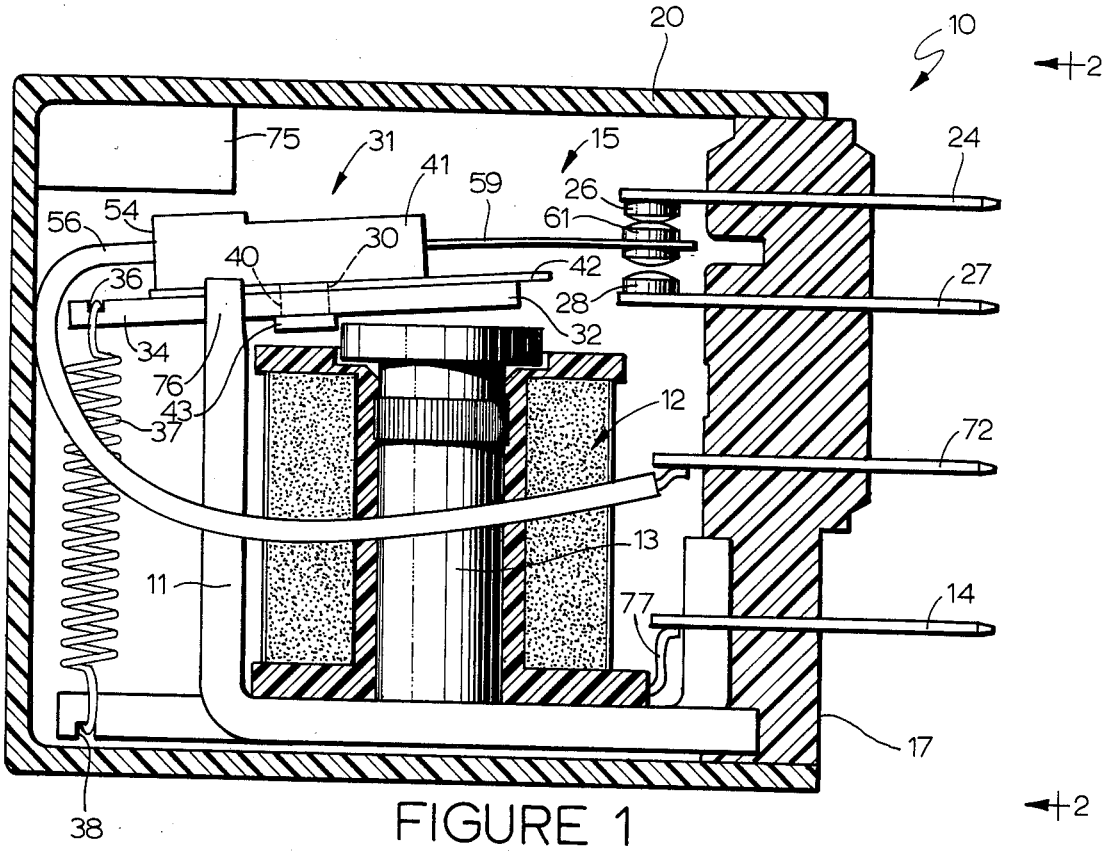
FIG. 1 schematically illustrates a relay incorporating the lead-attaching means and armature-retaining means of the present invention.
Figure 2:
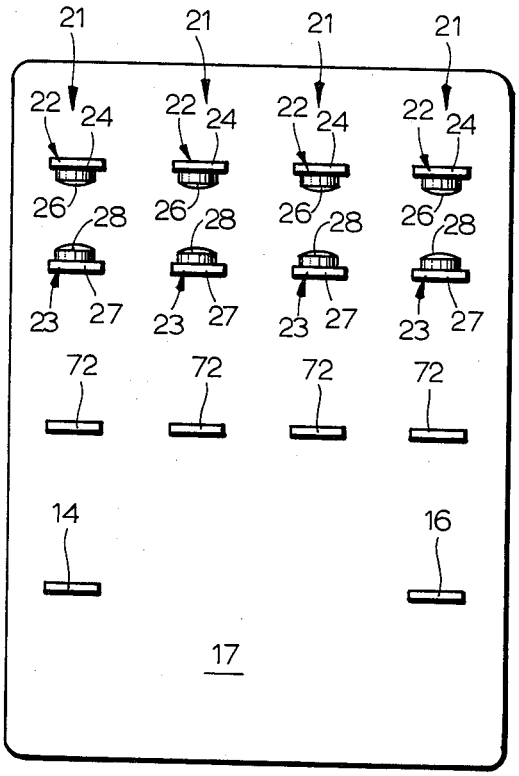
FIG. 2 illustrates a front view of the relay of FIG. 1 looking in the direction of arrow 2—2 of FIG. 1, with only certain details of the relay being shown for ease in explanation.

FIG. 1 illustrates a relay within which the lead-attaching means of the present invention may advantageously be employed. As most of the relay structure is not pertinent to the invention, it will not be described in detail. For completeness, however, FIG. 1 illustrates the relay assembly 10 as including a relay 15 enclosed within a plastic housing 20 of some suitable thermoplastic resin or the like. The relay includes a frame 11 supporting a coil assembly 12. A magnetic core 13 extends through the coil assembly and is attached to the base of the frame by staking or by any other appropriate procedure known in the art. A pair of coil leads 77 (only one is shown in FIG. 1) extends from the coil assembly and is coupled to terminals 14 and 16 which are mounted to and extend out the front face 17 as is best shown in FIG. 2.

Included within the relay are a plurality of stationary contact members which, in the embodiment being described herein, comprise four pairs of stationary contact members. These four pairs are best illustrated in FIG. 2 which is a view of the relay looking in the direction of arrow 2—2 in FIG. 1 and showing essentially only the terminals extending from the relay. Most other portions of the relay have not been illustrated in FIG. 2 for purposes of clarity.

The four pairs of stationary contact members are substantially identical; and each pair, designated by reference number 21, includes an upper, normally closed contact member 22 and a lower, normally open contact member 23. In the preferred embodiment, each of the upper contact members comprises an elongated, generally rectangular-shaped terminal portion 24 with its inner end supporting a contact button 26 and its outer end extending through the face 17 of the housing. Similarly, each of the lower contact members comprises an elongated, generally rectangular-shaped terminal portion 27 and extending through face 17 of the housing and supporting contact button 28 on its inner end. As is well known in the art, each of the four terminal pairs is adapted to be connected to a load to be controlled by the relay.

Supported on the relay frame 11 is an armature assembly 31 which includes an armature 32 pivotally supported in a notch formed in the upper edge of frame 11. Plastic housing 20 is formed to have a pair of stops 75 which extend from either side of the housing (only one stop is visible in FIG. 1). These stops are preferably formed integral with the cover and are located above the pivot area of the movable armature assembly. Their location, in conjunction with a pair of tabs 76 on either side of the relay frame (again, only one is visible in FIG. 1), keeps the armature assembly from being dislocated from the frame, even under high shock or impact conditions.

In the prior art, the armature is typically maintained on the frame of the relay by brackets attached to the frame and extending over or through the armature. This technique normally requires that additional space be provided to ensure adequate space for the armature movement and, in general, complicates the relay design from a mechanical point of view.

The armature comprises a generally rectangular-shaped plate of steel or the like (see also FIGS. 3 and 4) having a narrow rear neck portion 34 provided with a notch 36 to receive one end of a spring 37. The opposite end of the spring is held within a notch 38 formed in a portion of the relay frame 11.

As will be explained more fully hereinafter, spring 37 is adapted to normally maintain the armature assembly 31 in the position illustrated in FIG. 1 with the movable contact buttons 61 in contact with normally closed stationary contact buttons 26. When the coil assembly 12 is energized, however, the armature 32 will be drawn downwardly by the now magnetized core 13 and carry the movable contact buttons away from contacts 26 and against normally open stationary contact buttons 28. When the coil is de-energized, the core will release the armature; and the movable contact buttons will be returned to their original position by the spring 37.

Figure 3:
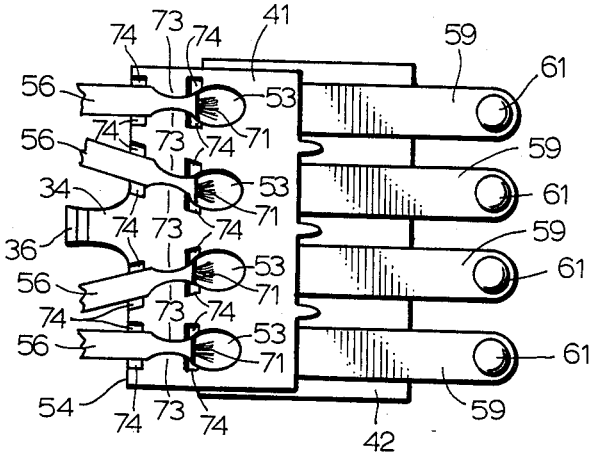
FIG. 3 illustrates a top view of the armature assembly of the relay of FIG. 1.
Figure 4:
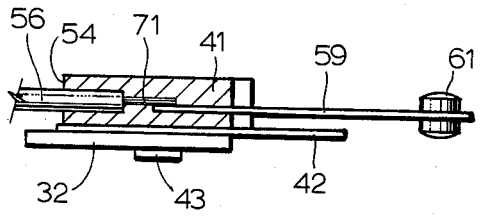
FIG. 4 illustrates a side view of the assembly of FIG. 3.

With reference to FIGS. 1, 3 and 4, the armature assembly 31 also includes a rectangular-shaped, support or carrier member 41 which is attached to and supported by the armature 32 and is formed of an appropriate rigid insulating material and, for a reason to be explained hereinafter, is preferably formed of a thermoplastic insulating material. Suitable materials for the carrier 41 include thermoplastic polyesters such as polyethylene terephthalate (PET) or polybutylene terephthalate (PBT), polyamides such as nylon or polyethermide polycarbonate (Ulthem). A plate or sheet 42 of insulating material, such as Mylar, may be provided between the armature 32 and the carrier 41 to assist in properly positioning the various elements with respect to one another and to ensure proper separation between various electrically conductive elements in the relay.

Figure 6:
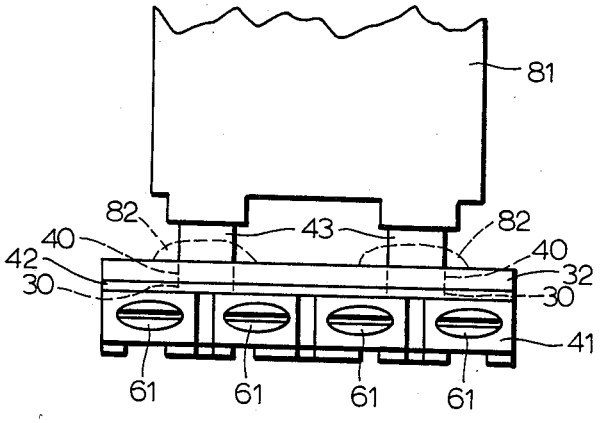
FIG. 6 schematically illustrates the presently preferred method for attaching the movable arm and lead-supporting carrier of the present invention to the armature of the relay.

The carrier 41 is provided with a pair of integral posts 43 (shown in FIG. 6) which are adapted to extend through aligned apertures 30 and 40 in plate 42 and armature 32, respectively, to firmly attach these elements together. As will be amplified on hereinafter, attachment is preferably accomplished by ultrasonically softening the ends of the posts to cause them to spread out and provide thickened knobs which, when cured, will firmly lock the elements together. Other methods of attachment could also be provided if desired.

Figure 5:
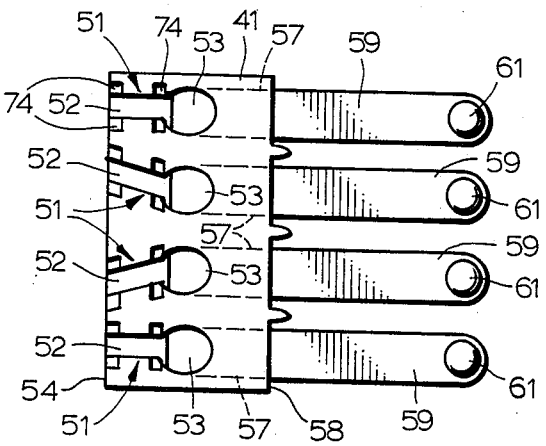
FIG. 5 illustrates the lead-attaching means of the present invention prior to its being incorporated into the assembly of FIGS. 3 and 4.

The detailed structure of carrier 41 can best be seen in FIGS. 3–5. FIG. 5, in particular, illustrates the initial construction of the carrier 41, while FIGS. 3 and 4 illustrate the carrier as part of the completed armature assembly.

As shown in FIG. 5, carrier 41 is provided with four passageways or grooves 51 which are formed in the top face of the carrier and extend into the carrier to a depth of about one-half the thickness of the carrier. Each of the grooves includes a relatively narrow slot portion 52 extending from the back face 54 of the carrier and terminating in a generally circular portion 53. The grooves are provided to receive and support four electrical leads as will be described more fully hereinafter.

Carrier 41 also includes four narrow openings 57 (shown in dotted line in FIG. 5) which extend from the front face 58 of the carrier into the carrier for a sufficient distance to intersect with the circular portions 53 of the grooves 51. These slots are adapted to receive the four movable contact arms 59.

Specifically, the movable contact arms comprise elongated strips of copper or other electrically conductive material which support movable contact buttons 61 on one end. The opposite ends of the strips extend through the slots 57 substantially fully into and exposed at the circular portions 53 of the grooves 51, as shown best in FIG. 5.

The slots 57 are separated from one another by the material of the carrier to keep the movable contact arms 59 electrically isolated from one another. Preferably, the carrier 41 and the contact arms 59 are attached together as a unit during the molding of the carrier by positioning the contact arms in the mold and molding the carrier around them. If desired, however, the carrier could be provided with slots to receive the contact arms and the arms attached in some other appropriate manner.

As mentioned above, the ends of electrical leads 56 are adapted to be positioned within passageways 51. Before being positioned, the ends of the insulating cover of the leads are removed to expose conductor wires 71. The leads are positioned such that the exposed wires will rest on and be in contact with the ends of movable contact arms 59. The wires can be electrically coupled to the arms by soldering, welding, or the like.

The leads 56 extend from the back face 54 of the carrier and are adapted to be coupled to terminals 72 (FIG. 2) which are mounted on and extend out the front face 17 of the relay assembly and are adapted to be connected to the loads to be controlled to complete the switching circuit. The leads can be connected to the inner ends of the terminals in any desired manner known in the art such as by soldering or welding. One lead 56 connected to a terminal 72 is shown in FIG. 1.

To complete the structure of the armature assembly 31, the leads, in addition to having exposed wires 71 attached to movable contact arms 59, are also firmly attached to the carrier 41. These attachments are made near the back edge 54 of the carrier where the insulating cover has not been removed from the leads; and although the manner of attachment may take any appropriate form, in the preferred embodiment it is accomplished by softening the carrier material adjacent both sides of the slots 52 by ultrasonic means and causing the material to extend over the leads and form lip portions 73 (FIG. 3) which, when cured, will hold the leads firmly in place. Four small grooves 74 are formed in the carrier 41 on either end of the slot portions 52 of each passageway to control the flow of the softened carrier material to form the lip portions 73 into the correct shape.

With carrier 41 in position on the relay to support the leads 56 at one end and the movable contact arms 59 at the opposite end, a long-lasting, reliably operating relay assembly is provided. As the armature assembly 31 pivots back and forth during the operation of the relay, the rigid carrier will absolutely prevent the leads from bending in the vicinity of the exposed wires 71. Instead, the bending forces will be shifted toward the back of the carrier where the leads are secured to the carrier by lip portions 73 of the carrier; and since the leads are still protected and strengthened by their insulating cover at this location, they will be much better able to withstand the bending forces.

The carrier 41 also provides a structure which permits the leads to be attached to the movable contact support member quickly and efficiently without significantly increasing the cost of manufacturing the relay and without necessitating an increase in the size of the relay to maintain adequate spacing between electrically conductive elements. For example, with reference to FIG. 6, by forming the carrier with integral posts 43, the carrier can be quickly secured to the armature 32 and to plate 42 by simply extending the posts through aligned apertures 30 and 40 in the plate and armature, respectively, turning the assembly upside down and bringing an ultrasonic vibrating tool 81 having a properly shaped tool head into contact with the ends of the two posts, heating and softening the plastic post material by ultrasonic vibration while simultaneously applying pressure against the posts causing them to spread out and form the domed shape 82 illustrated by dotted lines in FIG. 6 such that when the material cures and hardens, the elements will be rigidly locked together.

Although other fastening techniques, such as riveting, could also be used, these increase costs and make it difficult to meet the spacing requirements between electrically conductive components in the relay. In particular, the relay illustrated in FIGS. 1 and 2 is quite small, only about 25 cms. high; and if metal rivets extended through the carrier, they would have to be properly spaced from the lead wires and from the contact arms; and this would be difficult to accomplish without enlarging the carrier and possibly other parts of the relay as well.

In a similar manner, the leads can quickly be attached to the carrier by a single ultrasonic tool having a tool head properly shaped to soften and reshape the carrier material on either side of each slot 52 to form lip portions 73, while preformed grooves 74 help to ensure that the carrier material flows properly to define the lip portions. In prior art attachment techniques, each lead is usually clamped in place one at a time, a time-consuming, cost-increasing technique.

The contact arms are properly positioned in the carrier during the initial molding of the carrier, and the exposed wires of the leads are attached to the contact arms by soldering or welding after the components have all been assembled.

Although the invention has been described with reference to a relay having four sets of contacts for controlling four switching circuits, it should be understood that the invention could similarly be practiced with many other types of relays and relay designs. Also, it should be recognized that it is not intended to restrict the invention to use only with relays. The invention could find wide use in many applications where it is necessary to attach conductive leads to a movable element. Because the invention can take many other forms, it is intended that all such changes and modifications be covered by the following claims.

I claim:

1. A relay including stationary contact means, movable contact means, means including an armature for moving said movable contact means relative to said stationary contact means to operate said relay, and coupling means for coupling electrically conductive lead means to said movable contact means, characterized in that said coupling means comprises a carrier (41) formed of insulating material and mounted to said armature (32) for movement therewith, said carrier supporting said lead means (56) and said movable contact means (31) in electrical contact with one another at a first location on said lead means, said carrier (41) further including means (73) integral therewith for attaching said lead means (56) to said carrier (41) at a second location on said lead means (56) spaced from said first location.

2. A relay as recited in claim 1 wherein said first location comprises a location at which the insulating cover of said lead means (56) has been removed to expose conductor means (71) therein, and wherein said second location comprises a location at which said insulating cover is intract.

3. A relay as recited in claim 1 wherein said attaching means comprises integral lip means (73) reformed over said lead means (56) at said second location on said lead means 56.

4. A relay as recited in claim 1 wherein said carrier (41) includes groove means (51) provided on a surface thereof for supporting said lead means (56) therein, and wherein said attaching means comprises lip means (73) extending over said lead means (56) at said second location for retaining said lead means (56) in said groove means (51).

5. A relay as recited in claim 4 wherein said lead means (56) extends into said groove means (51) from a first end of said carrier (41), and wherein said movable contact means (31) extends into said carrier (41) from a second end of said carrier (41) opposite said first end, and wherein said second location is closer to said first end of said carrier (41) than said first location when said lead means (56) is supported within said groove means (51).

6. A relay as recited in claim 1 and further including means for mounting said carrier (41) to said armature (32), said mounting means including post means (43) integral with said carrier (41) extending through aligned aperture means (40) in said armature means (32).

7. A relay as recited in claim 1 wherein said stationary contact means (21) comprises a plurality of pairs of stationary contact means, said movable contact means (31) comprises a plurality of movable contact means, and said lead means (56) comprises a plurality of lead means, each of said plurality of lead means (56) being supported by said carrier (41) in electrical contact with a different one of said plurality of movable contact means (31) at a first location on each of said plurality of lead means (51), and wherein said attaching means (73) includes a plurality of means integral with said carrier (41) (56) for attaching each of said plurality of lead means to said carrier (41) at a second location on each of said lead means (56).

8. A relay as recited in claim 7 wherein said carrier (41) comprises a plurality of groove means (51) extending from one end thereof for receiving said plurality of lead means (56) therein, and wherein said plurality of movable contact means (31) extend into said carrier from the opposite end thereof, each of said plurality of movable contact means intersecting with a different one of said plurality of groove means such that each of said plurality of lead means is supported in electrical contact with a different one of said plurality of movable contact means.

9. A relay as recited in claim 8 wherein said carrier is formed of a thermoplastic insulating material and wherein said attaching means comprises a plurality of lip means integral with said carrier and extending over each of said plurality of lead means in said plurality of groove means for securing said plurality of lead means to said carrier at said second location on each of said plurality of lead means.

10. A relay including a plurality of stationary contact means, a plurality of movable contact means, means for moving said plurality of movable contact means relative to said plurality of stationary contact means to operate said relay, and coupling means for coupling a plurality of electrically conductive leads to said plurality of movable contact means for incorporating said plurality of movable contact means into electrical switching circuits, characterized in that said coupling means comprises a carrier (41) of thermoplastic, insulating material for supporting each of said plurality of leads (56) in electrical contact with a different one of said plurality of movable contact means (59) at first locations on said plurality of leads (56), and means (73) for attaching said plurality of leads (56) to said carrier (41) at second locations on said leads (56) spaced from said first locations such that forces applied to said plurality of leads as a result of the movement of said plurality of movable contact means (59) will be applied to said plurality of leads (56) at said second locations, said attaching means including a plurality of integral lip portions (73) on said carrier (41) reformed over said leads (56) at said second locations.

11. A relay as recited in claim 10 wherein said first locations comprise locations at which the insulating cover of said plurality of leads (56) has been removed to expose conductor mean (71) therein, and wherein said second locations comprise locations at which said insulating cover is intact.

12. A relay as recited in claim 10 wherein said means for moving said plurality of movable contact means (59) includes armature means (32) and wherein said relay further includes means (43) for mounting said carrier (41) to said armature means (32) for movement therewith.

13. A relay as recited in claim 12 wherein said mounting means includes post means (43) integral with said carrier and which extend through aligned apertures (40) in said armature means.

14. A relay as recited in claim 10 wherein said carrier comprises a plurality of groove means (51) extending from one end (54) thereof for receiving said plurality of leads (56), and wherein said plurality of movable contact means (59) extend into said carrier (41) from the opposite end (58) thereof, each of said plurality of movable contact means (59) intersecting with a different one of said plurality of groove means (51) such that each of said plurality of leads (56) are supported in electrical contact with a different one of said plurality of movable contact means (59), and wherein said lip means (73) extends over each of said plurality of leads (56) for securing said plurality of leads (56) within said plurality of groove means (51).

15. A method for supporting an electrically conductive lead with conductor means in electrical contact with a movable contact means in a relay characterized by the steps of:

a. providing a carrier (41) formed of insulating material;
b. supporting said lead (56) by said carrier (41) in electrical contact with said movable contact means (59) at a first location on said lead (56) where the conductor means within said lead is exposed; and
c. attaching said lead (56) to said carrier (41) at a second location on said lead (56) spaced from said first location where the insulating cover to said lead is intact, said attaching step including the step of reforming at least a portion of said carrier (41) around at least a portion of said lead (56) for securing said lead (56) in position to said carrier (41).

16. A method as recited in claim 15 wherein said providing step comprises a providing a carrier (41) of thermoplastic insulating material, and wherein said reforming step comprises the steps of heating at least a portion of said carrier (41) to soften said portion, reforming said softened portion around at least a portion of said lead (56), and allowing said reformed portion to cool and set to secure said lead (56) in position to said carrier (41).

17. A method as recited in claim 16 wherein said heating step and said reforming step comprises the step of ultrasonically vibrating said portion of said carrier (41) for heating said portion and simultaneously reforming said portion.

18. A method as recited in claim 16 wherein said carrier (41) includes a plurality of grooves (51) for receiving a plurality of leads (56) and wherein said reforming step comprises the steps of simultaneously heating at least portions of said carrier (41) on either side of said plurality of grooves (51), simultaneously reforming said softened portions to define lip portions (73) extending over said plurality of leads (56) from either side of said plurality of grooves (51), and allowing said lip portions (73) to cool and set to secure said plurality of leads (56) to said carrier (41).

19. A method as recited in claim 18 wherein said heating step and said reforming step comprises the step of ultrasonically vibrating said portions for heating said portions and simultaneously reforming said portions.

20. A method as recited in claim 16 and further including the steps of securing said carrier (41) to an armature (32), said securing step including the steps of extending post means (43) integral with said carrier (41) through aperture means in said armature (32), heating said post means (43) to soften it, reforming said heated post means (43), and allowing said reformed post means (43) to cool and set to secure said carrier (41) to said armature (32).

21. A method as recited in claim 20 wherein said steps of heating said reforming said post means (43) comprises the steps of heating said post means (43) by ultrasonic vibration and simultaneously reforming said post means (43).

22. A method as recited in claim 18 wherein said movable contact means (31) includes a plurality of movable contact support members and wherein said method includes the step of molding said carrier (41) around a portion of each of said plurality of movable contact support members to secure said movable contact support members within said carrier (41).

23. A method for supporting an electrically conductive lead in electrical contact with a movable element characterized by the steps of attaching a carrier (41) to said movable element (31), supporting said lead (56) by said carrier (41) in electrical contact with said movable element (31) at a first location on said lead (56), and attaching said lead (56) to said carrier (41) at a second location on said lead (56) spaced from said first location wherein said attaching step comprises the step of reforming lip means (73) integral with said carrier (41) over said lead (56) to secure said lead (56) to said carrier (41).

24. A method as recited in claim 23 wherein said carrier (41) is formed of thermoplastic material, and wherein said reforming step comprises the steps of heating at least a portion of said carrier (41) to soften said portion, reforming said softened portions around said lead (56), and allowing said reformed portion to cool and set to secure said lead (56) to said carrier (41).

25. A method as recited in claim 24 wherein said steps of heating and reforming comprise the steps of ultrasonically vibrating said portion to heat said portion and simultaneously reforming said portion.

26. A relay as recited in claim 4 wherein said lip means (73) comprise lip portions extending over said lead means (56) from either side of said groove means (51).

27. A relay as recited in claim 1 wherein said carrier (41) is formed of a thermoplastic, insulating material.

28. A relay as recited in claim 14 wherein said plurality of lip means (73) extend over said plurality of leads (56) from either side of said plurality of groove means (59).

* * * * *

UNITED STATES PATENT AND TRADEMARK OFFICE

CERTIFICATE OF CORRECTION

PATENT NO. : 4,599,588

DATED : July 8, 1986

INVENTOR(S) : Richard E. Bell

It is certified that error appears in the above-identified patent and that said Letters Patent is hereby corrected as shown below:

In col. 1, line 60, delete "are" and insert --is-- therefor.

In col. 2, line 25, delete "is" and insert --are-- therefor.

In col. 3, line 35, delete "are" and insert --is-- therefor.

In claim 2, line 6, delete "intract" and insert --intact-- therefor.

In claim 7, line 12, delete "(56)"; line 13, after "means", insert --(56)--.

In claim 8, line 5, delete "extend" and insert --extends-- therefor.

In claim 14, line 9, delete "are" and insert --is-- therefor.

In claim 15, line 13, delete "to" and insert --of-- therefor;

UNITED STATES PATENT AND TRADEMARK OFFICE

CERTIFICATE OF CORRECTION

PATENT NO. : 4,599,588

DATED : July 8, 1986

INVENTOR(S) : Richard E. Bell

It is certified that error appears in the above-identified patent and that said Letters Patent is hereby corrected as shown below:

In claim 16, line 2, delete "a".

In claim 17, line 2, delete "comprises" and insert --comprise-- therefor.

In claim 19, line 2, delete "comprises" and insert --comprise-- therefor.

In claim 21, line 2, delete "said" (first occurrence), and insert --and-- therefor.

In claim 24, line 5, delete "portions" and insert --portion-- therefor.

In claim 28, line 2, delete "extend" and insert --extends-- therefor.

Signed and Sealed this

Seventh Day of October, 1986

[SEAL]

*Attest:*

DONALD J. QUIGG

*Attesting Officer*

*Commissioner of Patents and Trademarks*